United States Patent [19]

Hannah

[11] 4,443,046

[45] Apr. 17, 1984

[54] DESK ASSEMBLY

[75] Inventor: Bruce H. Hannah, Cold Spring, N.Y.

[73] Assignee: Knoll International, Inc., New York, N.Y.

[21] Appl. No.: 419,189

[22] Filed: Sep. 17, 1982

Related U.S. Application Data

[62] Division of Ser. No. 153,867, May 28, 1980.

[51] Int. Cl.[3] ..... A47B 63/00; B65D 57/00

[52] U.S. Cl. ..... 312/183; 312/185; 312/187; 220/22.1; 220/22.2; 211/50

[58] Field of Search ..... 312/183, 185, 187, 191; 211/50; 220/22, 22.1, 22.2

[56] References Cited

U.S. PATENT DOCUMENTS

| | | | |
|---|---|---|---|
| 1,448,197 | 3/1923 | Chisholm | 220/22.1 |
| 1,571,330 | 2/1926 | Gollnick | 220/22.1 |
| 2,615,592 | 10/1952 | Swedman | 220/22.1 |
| 2,728,482 | 12/1955 | Driver | 220/22 |
| 3,429,628 | 2/1969 | Laszlo | 220/22 |
| 4,081,100 | 3/1978 | Presby | 220/22.1 |
| 4,102,470 | 7/1978 | Timmons | 312/183 |

*Primary Examiner*—Victor N. Sakran

*Attorney, Agent, or Firm*—Robert Scobey

[57] ABSTRACT

A desk assembly is disclosed utilizing a framework for supporting side and back panels and file drawer slide assemblies. Adjacent frameworks may be clipped together to form a credenza; they may be spaced apart and joined together by a desk top slab; an extension may be added to form an L-shaped desk unit. An accessory-holding track assembly is included formed from an extruded track with exposed and internal channels. Accessories are positioned in the exposed channel; support members are positioned in the non-exposed channels. Identical slide drawers are utilized, with boxes therein of differing heights. Drawer fronts of differing heights corresponding to the different heights of the boxes are utilized. The entire framework is filled with file drawer boxes of differing heights, and the module is fronted by corresponding drawer fronts of differing heights. A file drawer compressor or follower is used, resiliently biased against the sides of a file drawer. A shelf holder for a file drawer assembly is included, utilizing a fluted member into which shelves are inserted, the shelves holding the fluted member in position against the framework. Stationary inserts and a locking mechanism are also disclosed.

2 Claims, 26 Drawing Figures

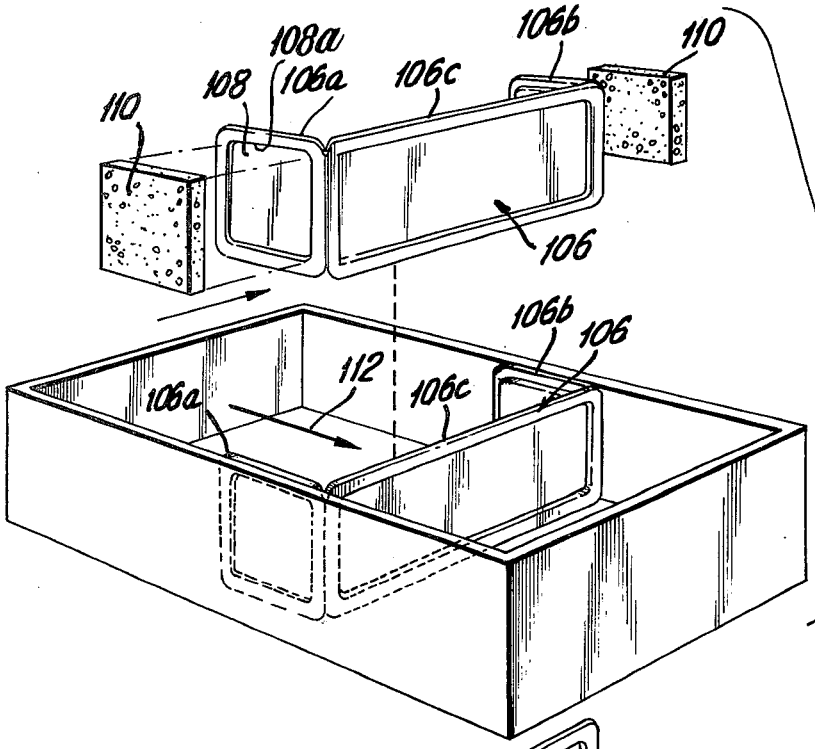
FIG. 13a.
FIG. 13b.
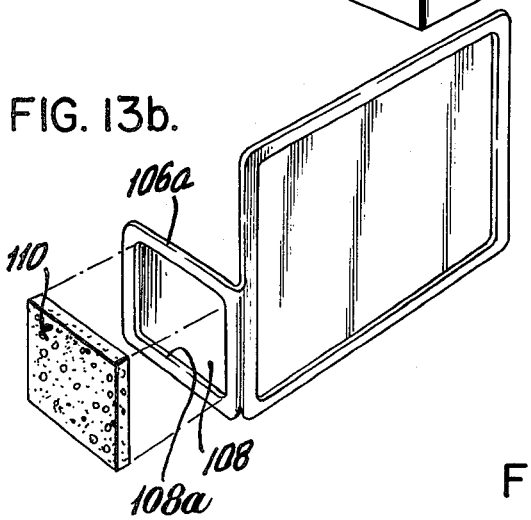
FIG. 13c.
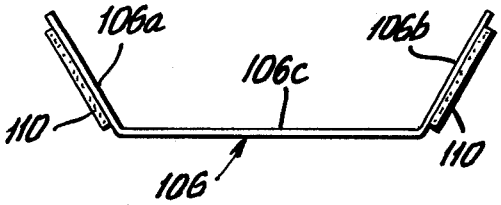
FIG. 13d.
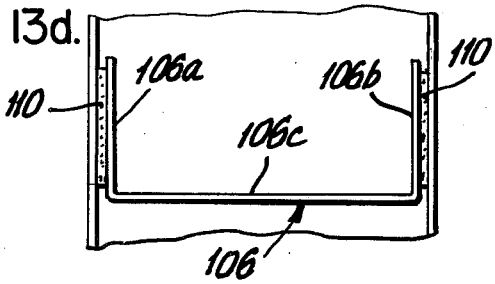

DESK ASSEMBLY

This is a division of application Ser. No. 153,867 filed May 28, 1980.

BACKGROUND AND BRIEF DESCRIPTION OF THE INVENTION

This invention relates to modular furniture. More particularly it provides a desk or pedestal module useful for forming a number of different items such as desks, credenzas and the like.

The invention recognizes the need for mass producing furniture with a minimum number of parts and a maximum number of combinational possibilities so that different items of furniture may be fabricated from a basic set of component parts. Thus, in the present invention, a basic desk or pedestal module is provided, formed from a framework for supporting side and back panels and file drawer slide assemblies. File drawers of identical dimensions with inserts of differing dimensions and corresponding file drawer fronts of corresponding differing dimensions are used to fill the space within the framework and to close off the front thereof, thereby to complete the basic module. Two or more of such modules may be joined together in side-by-side fashion to form a credenza, for example, or they may be stacked to form a filing cabinet, e.g. Alternatively, two of such modules may be spaced-apart, with a desk top bridging the two modules to form a basic desk unit. An extension may be added to that desk unit by way of an additional module and desk top (to form a L-shaped desk assembly, for example). An accessory track assembly may be joined to the rear of the desk top for holding accessories and also for containing utilities, as needed. The track assembly is advantageously formed from an extruded track with an upwardly exposed accessory-holding channel on one side thereof and one or more interior, downwardly exposed channels for holding brackets, and the like.

The invention contemplates a file drawer locking mechanism including a lock block carried on one of the sides of each file drawer. The block is slidable forwardly and rearwardly on the file drawer between locked and unlocked positions. A lock bar carried by the basic framework engages only those of the lock blocks in locked positions, thereby permitting those of the drawers having blocks in unlocked positions to open and close freely, thereby to provide for selective locking of drawers within the assembly.

The invention also contemplates various accessories, such as a file drawer compressor or follower having sides resiliently biased against the sides of a file drawer for dividing the space within a file drawer, as well as various stationary inserts. Additionally, a fluted shelf insert is utilized for positioning within the framework, held in place essentially by the shelves that engage the channels defined by the fluted shelf inserts.

By utilizing a modular assembly and by making parts as identical as possible, production costs are decreased and assembly is facilitated. Thus, all file drawers are of identical shape, and box inserts of differing shapes are utilized to provide for different filing capabilities. Various file drawer inserts are used, such as pencil trays, dividers, and the like to achieve different filing capabilities. Thus an extremely versatile system is presented.

The invention will be more completely understood by reference to the following detailed description, taken in conjunction with the appended drawings.

BRIEF DESCRIPTION OF THE DRAWINGS

FIG. 13*a* is an exploded perspective view showing the details of a file drawer compressor or follower.

FIG. 13*b* is a view of a file drawer compressor.

FIG. 13*c* is a top view of the compressor shown in FIGS. 13*a* and 13*b*, prior to its insertion into a file drawer.

FIG. 13*d* is a view as in FIG. 13*c*, showing the compressor in place in a file drawer.

DETAILED DESCRIPTION

Figure 1:
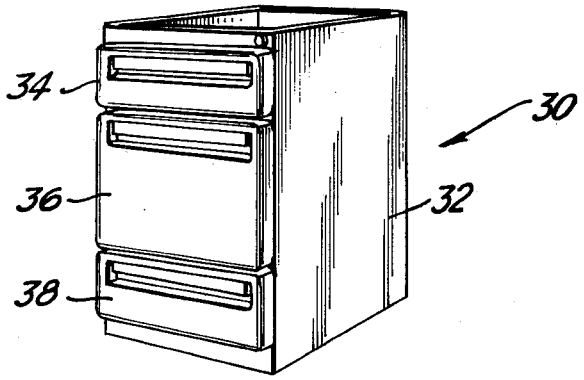
FIG. 1 is a perspective view of a basic desk or pedestal module in accordance with the invention.
Figure 2:
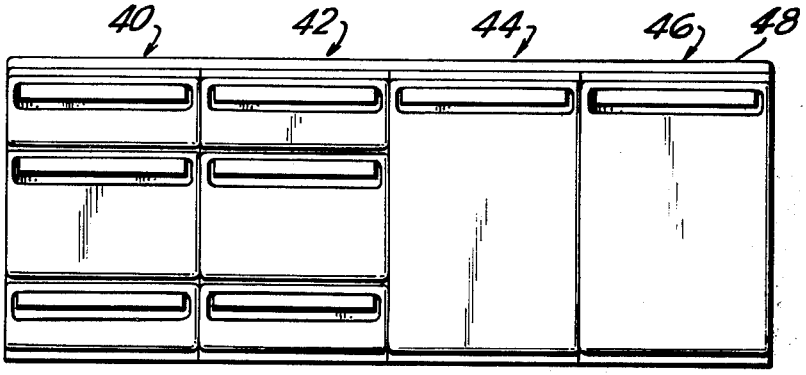
FIG. 2 is a front view of a series of four modules of the type shown in FIG. 1, joined together in side-by-side fashion to form a credenza.

Referring to FIG. 1, a basic desk or pedestal module 30 is shown. In the perspective view of FIG. 1, a side panel 32 and drawer fronts 34, 36, and 38 are visible. The two drawer fronts 34 and 38 are identical; the drawer front 36 is about twice as high as the drawer fronts 34 and 38. These different drawer fronts are attached to file drawers of identical size, as will be explained in more detail below. FIG. 2 shows four of such basic modules as shown in FIG. 1, joined together in side-by-side fashion to form a credenza. In this case, the two modules 40 and 42 are identical to the module 30 shown in FIG. 1. The two modules 44 and 46 differ in that they include a single drawer front rather than individual drawer fronts. The modules are joined together, as will be explained in more detail below, and include a top 48 thereon.

Figure 3:
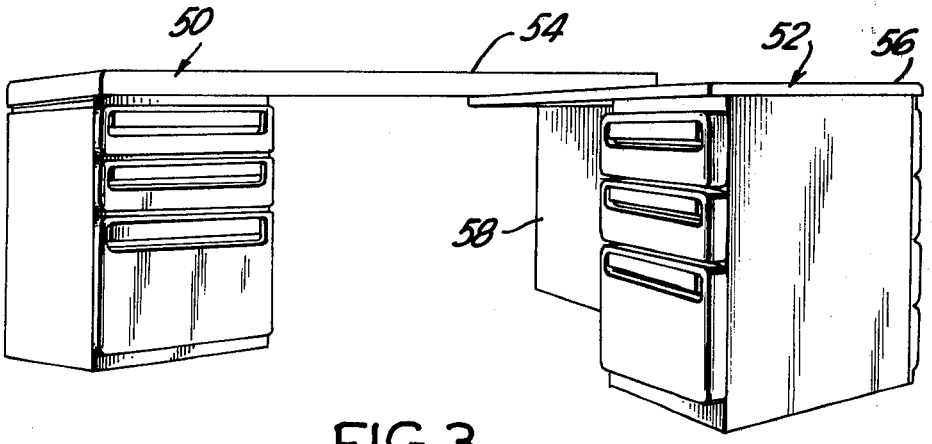
FIG. 3 is a perspective view of two of the modules of the type shown in FIG. 1, joined together by desk tops to form an L-shaped desk assembly.

FIG. 3 shows in perspective view two modules 50 and 52 of the general type of the module 30 shown in FIG. 1, joined together by desk top slabs 54 and 56. In this case, the desk is terminated by a vertical panel 58 rather than another module of the type as shown in FIG. 1.

Figure 4:
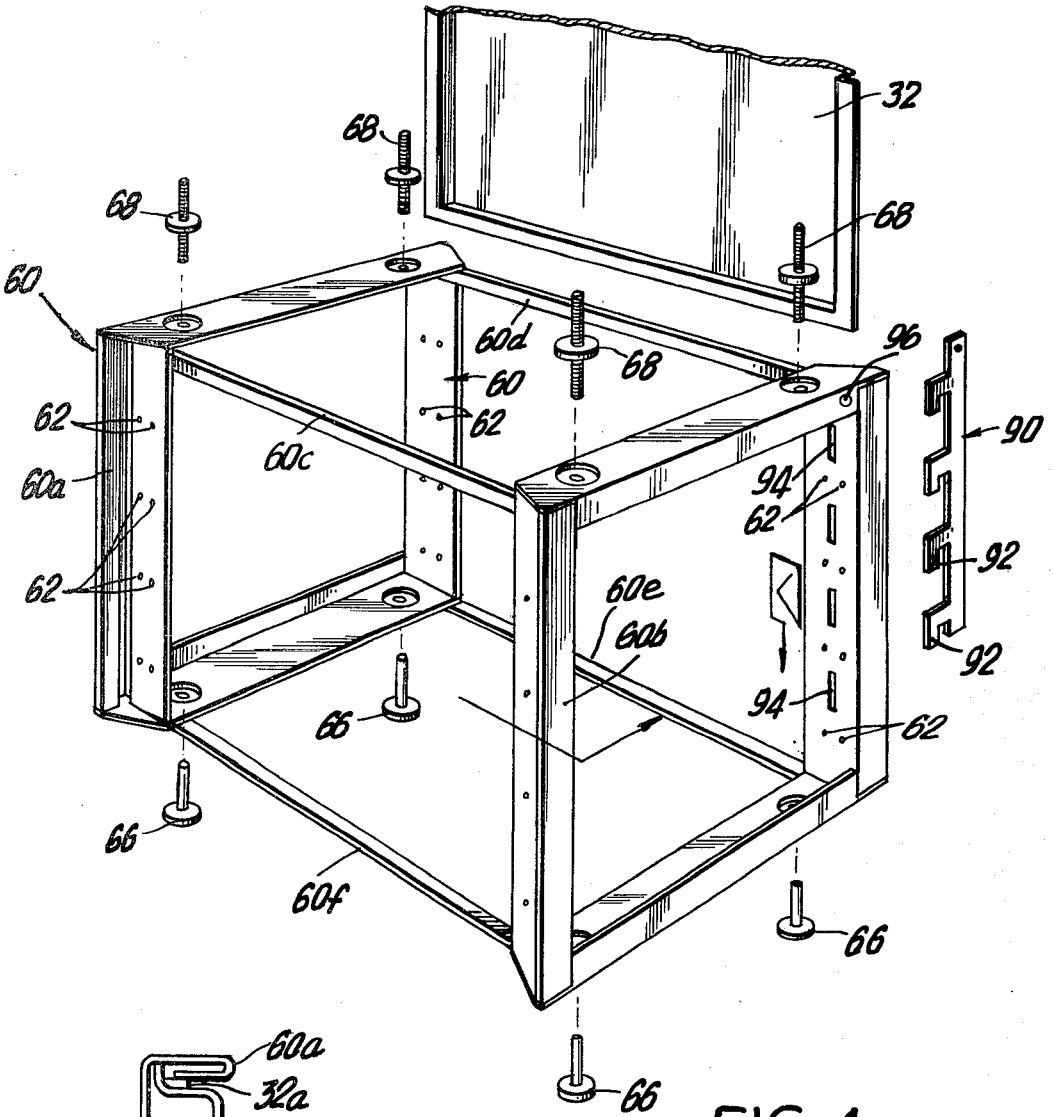
FIG. 4 is an exploded perspective view of the basic framework used to form the module of FIG. 1.
Figure 6:
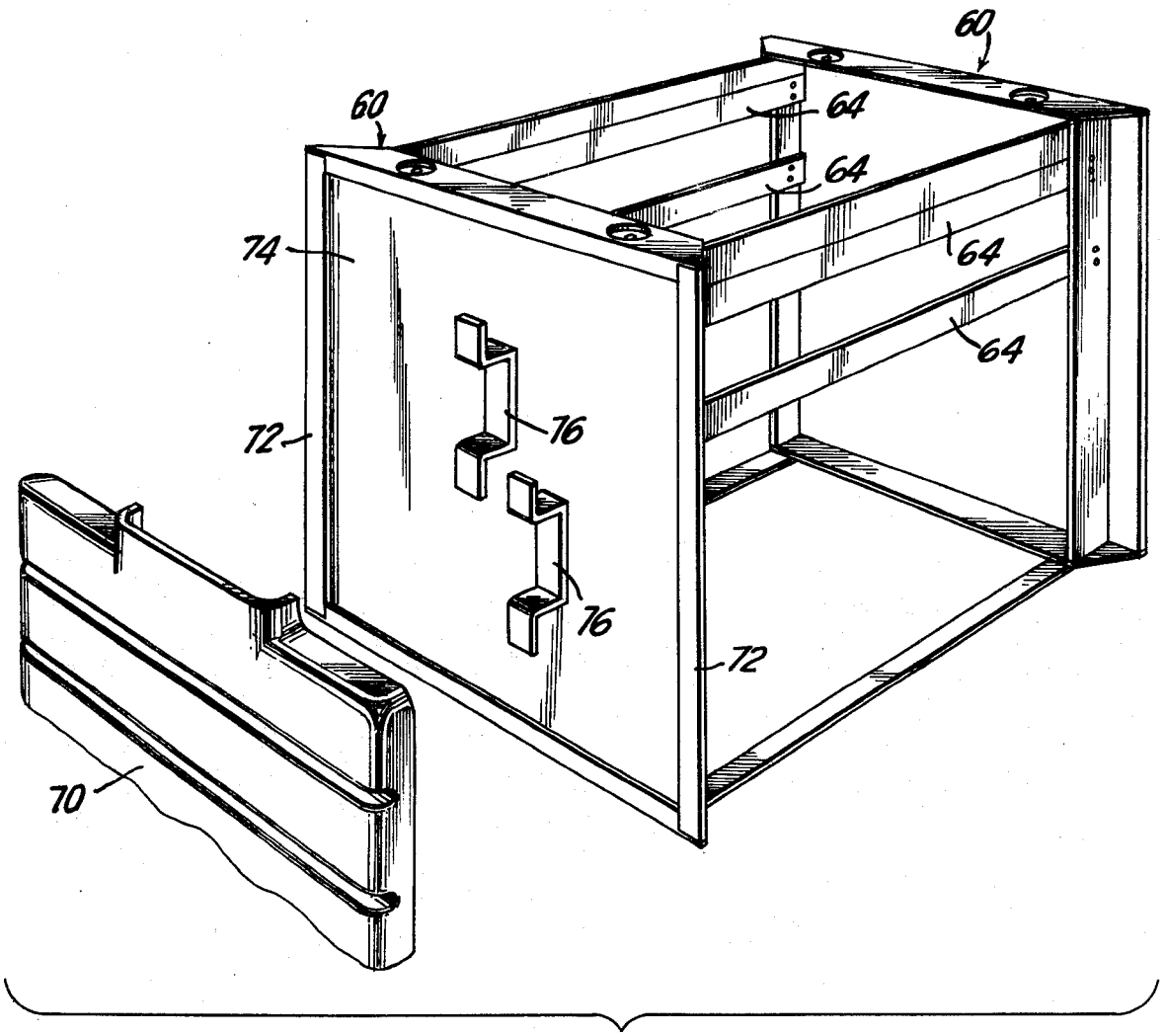
FIG. 6 is an exploded perspective view of the framework of FIG. 4, showing the details of the fitting of a back panel.

Refer now to FIG. 4. This figure shows a basic framework 60 used to form the module. The framework consists of end pieces 60*a* and 60*b* (rectangular in shape and identical to each other). The two frame pieces 60*a* and 60*b* are joined together by frame strips 60*c*, 60*d*, 60*e*, and 60*f*. Uniformly spaced mounting holes 62 are provided in the frame pieces 60*a* and 60*b* to support file drawer slide assemblies, as needed. Two pairs of such file drawer slide assemblies 64 are shown in FIG. 6. The invention utilizes identically shaped file drawers, with differently shaped inserts for those drawers to provide for differing filing capabilities, as will be explained in more detail below. Accordingly, the framework 60 includes the uniformly spaced slide assembly mounting holes 62 for the mounting of one or more pairs of slide assemblies, as needed.

The framework is supported by glides 66. Spacer connectors 68 are included at the top of the framework for supporting a suitable top structure of the top thereof. The spacer connectors 68 are threaded to be held by the framework 60 as well as the top structure.

Figure 5:
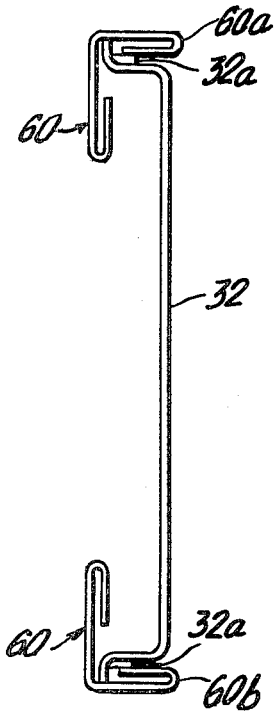
FIG. 5 is a view looking downwardly on one side of the framework of FIG. 4, showing a side positioned within the framework.
Figure 7:
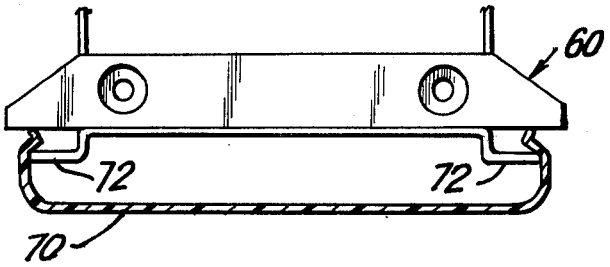
FIG. 7 is a view looking downwardly on a part of the framework of FIG. 6, showing the back panel in place.

FIG. 5 is a view looking downwardly showing the details of the mounting of the side panel 32 of FIG. 1 to the framework elements 60*a* and 60*b*. The side piece 32 includes projections 32*a* along the lower edge thereof which engage corresponding portions of the frame pieces 60*a* and 60*b* when the side piece 32 is positioned as shown in FIG. 1. Two identical side pieces 32 are employed, as shown. FIG. 6 shows the details of a back piece 70. That back piece snaps into place, as shown in FIG. 7, and is held in place by a framework element 72. As shown in FIG. 6, the module includes a security panel 74 at the rear thereof, closing off the rear of the module along with the back piece 70. Security panel 74 may include brackets 76 thereon for holding electrical wires, for example, in place. Referring again to FIG. 4, and considering FIG. 3, the spacer connectors 68 are typically threaded into the top structure beforehand, such as the top slabs 54 and 56 shown in FIG. 6. The top slabs are then dropped onto the frameworks 60 of the corresponding modules, and the tops are held in place by nuts threaded onto the lower threaded end of the spacer connectors 68 (which pass through the adjacent pieces of the frameworks 60). It will be noted from FIG. 3 that the two desk top slabs shown are of differing thicknesses. It is a feature of this system that the height of the desk top surface is determined by the thickness of the desk top. Thus, working surfaces of two different heights are present in the desk assembly as shown in FIG. 3.

Figure 8:
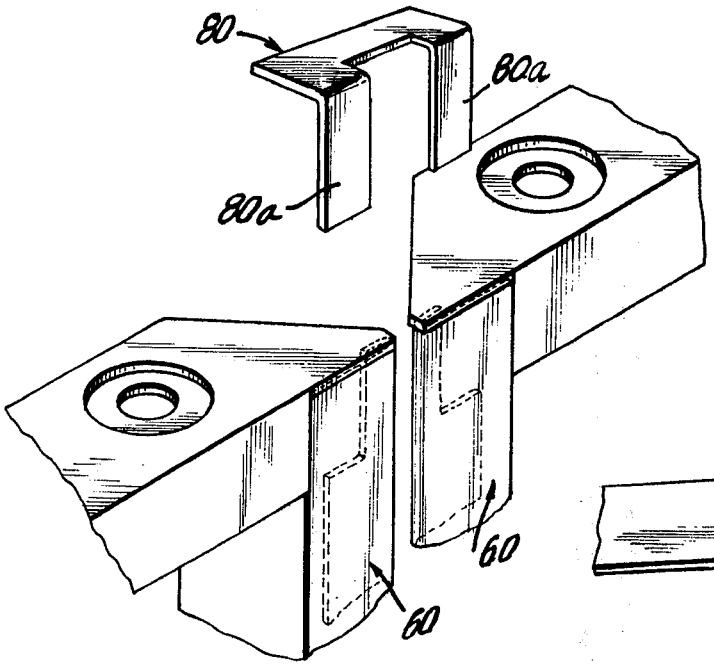
FIG. 8 is a perspectiv view of part of two adjacent frameworks, showing their joining together by a clip member in side-by-side fashion.
Figure 9A:
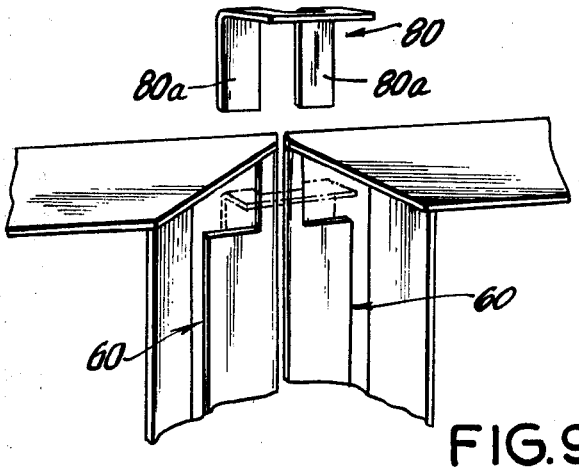
FIGS. 9*a* and 9*b* are similar to FIG. 8.
Figure 9C:
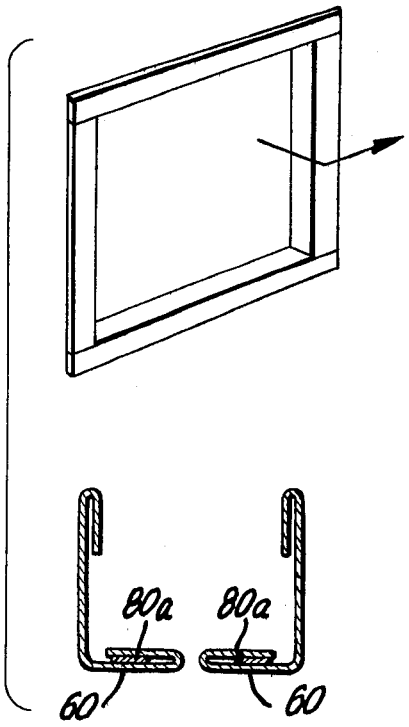
FIGS. 9*c* and 9*d* illustrate in somewhat different fashion the joining together of adjacent frameworks.
Figure 9B:
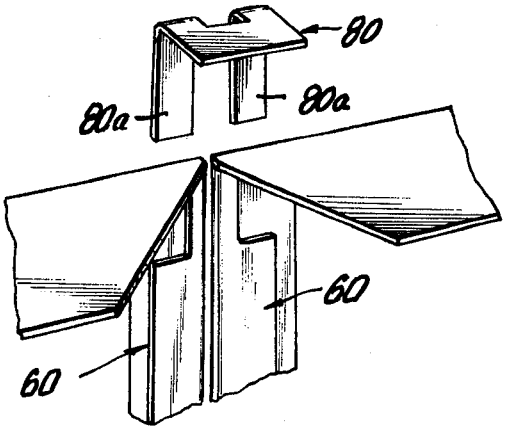
Figure 9D:
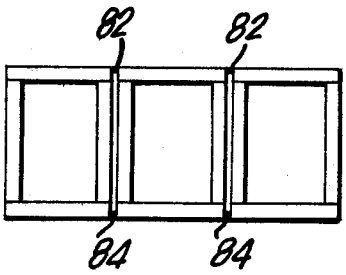

As shown in FIG. 2, a plurality of the basic desk or pedestal modules may be mounted in side-by-side fashion to form a credenza, for example. The individual modules are clipped together as shown in FIGS. 8 and 9. Specifically, a clip 80 is employed having two spaced legs 80*a*. These legs releasably engage the clip-engaging portions of the angle pieces of two adjacent frameworks 60, as shown in FIG. 8. FIGS. 9*a* and 9*b* are similar to FIG. 8, and show the clip. FIG. 9*c* is a sectional view showing two frameworks 60 and the clip legs 80*a*. FIG. 9*d* is a schematic view simply showing the clipping together of adjacent modules at upper positions 82 and lower positions 84. The modules are also obviously held together by the top slab 48 shown in FIG. 2.

Figure 10:
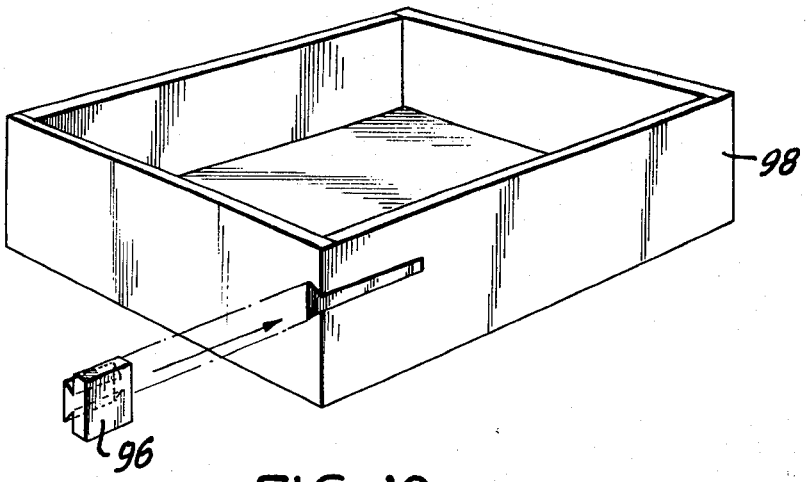
FIG. 10 is a perspective view of one of the file drawers, showing a lock block used for locking purposes.
Figure 11:
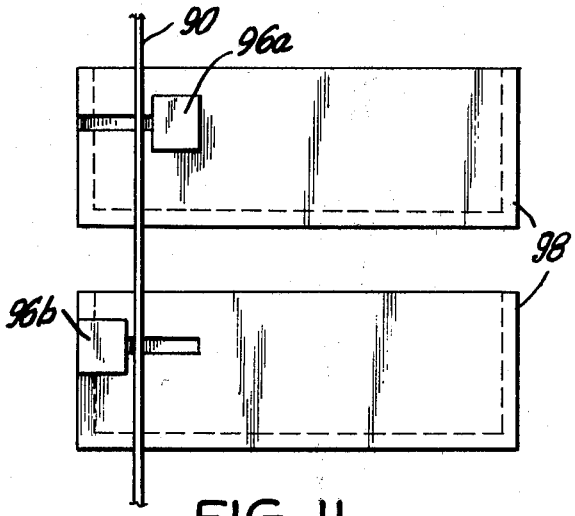
FIG. 11 is a side view of two file drawers showing the details of the locking mechanism.

Referring again to FIG. 4, a lock bar 90 is shown having lock portions 92 which pass through associated slots 94 in framework piece 60*b*. The lock bar is slidable vertically, under the control of a locking key mechanism 96. FIGS. 10 and 11 show the details of the corresponding locking mechanisms included on the file drawers. As shown in FIG. 10, a lock block 96 is included which is mounted for forward and rearward sliding movement in one of the sides 98 of the drawer shown in FIG. 10. The rearward position of the lock block is the drawer locked position, and is the position that the lock block 96*a* assumes shown in FIG. 11. The forward position of the lock block is the unlocked position, and is the position assumed by lock block 96*b* in FIG. 11. The locking function is as follows. The lock blocks 96 of those drawers that are to be locked are moved to the rearward or locked positions, while the lock blocks of those drawers that are to remain unlocked are moved to the forward or unlocked position. When the lock bar 90 is raised to its uppermost position, all of the drawers may be moved inwardly and outwardly (closed and opened) at will. When the lock bar 90 is moved to its lowermost position, the locking portions 92 engage those lock blocks in the locked positions, preventing those drawers from being opened, while the remaining drawers are free to be opened because the corresponding lock blocks are in front of the lock bar. This operation is apparent from FIG. 11.

Figure 12:
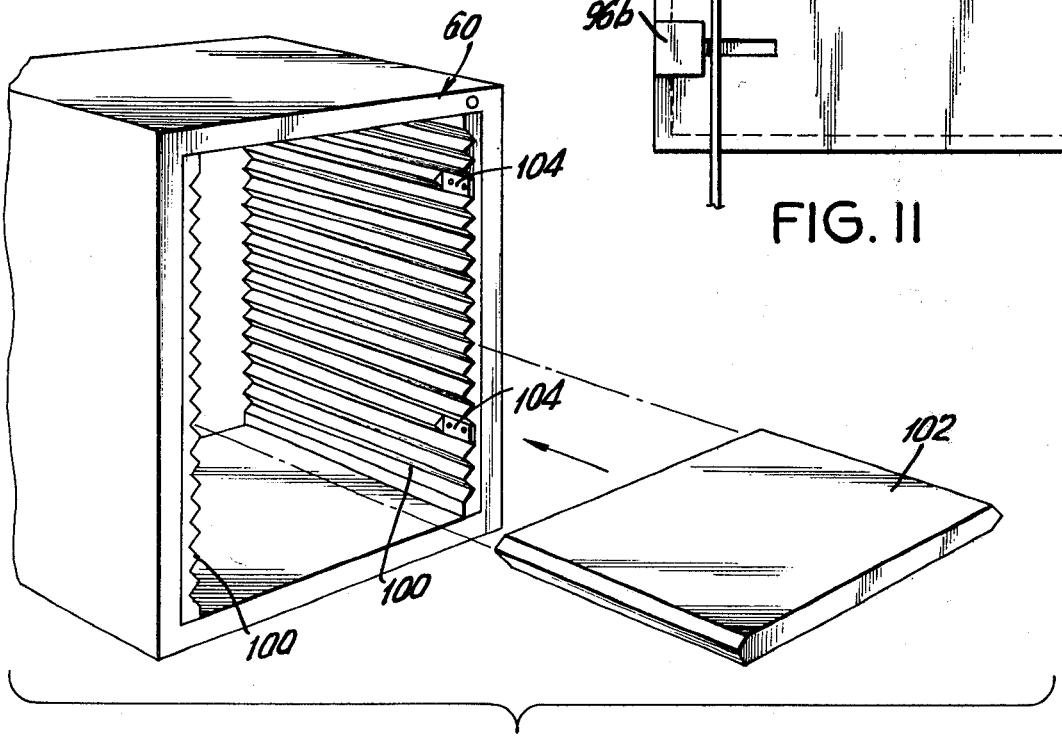
FIG. 12 is a perspective view of the basic framework, showing the details of a shelf insert for holding shelving.

Referring now to FIG. 12, the details of shelving within one of the modules is illustrated. A shelf insert 100 is utilized on each of two opposed sides of the framework 60. The shelf insert is a fluted member that defines a series of parallel channels for holding shelves such as shelf 102 therein. Each shelf insert is lightly fastened to the basic framework, i.e., by fastenings 104. The fastenings 104 may constitute parts of hinge assemblies for holding a door, such as the door 46 shown in FIG. 2. Otherwise, the shelf inserts 100 are held in place only by the shelving 102 placed therein, which urges the shelf inserts against the basic framework of the module.

Referring to FIGS. 13*a* to 13*d*, a file drawer compressor or follower is shown. A sheet of deformable or stiffly flexible material 106 is employed which is generally U-shaped. The compressor 106 constitutes side pieces 106*a* and 106*b* and a bridging piece 106*c*. The side pieces 106*a* and 106*b* are biased outwardly normally (FIG. 13*c*), and they include recesses in the outside surfaces thereof (e.g., the recess 108 in side piece 106*a*). Each recess includes a retaining wall 108*a* about the periphery thereof, and a foam or other compressible material insert 110 is glued into the recess and held by the retaining wall. In this fashion the compressible pieces 110 bear against the sides of the file drawer when the compressor 106 is positioned within the file drawer. That compressor may be moved in the direction of arrow 112 in FIG. 13, but it may not be moved in the reverse direction.

Figure 14A:
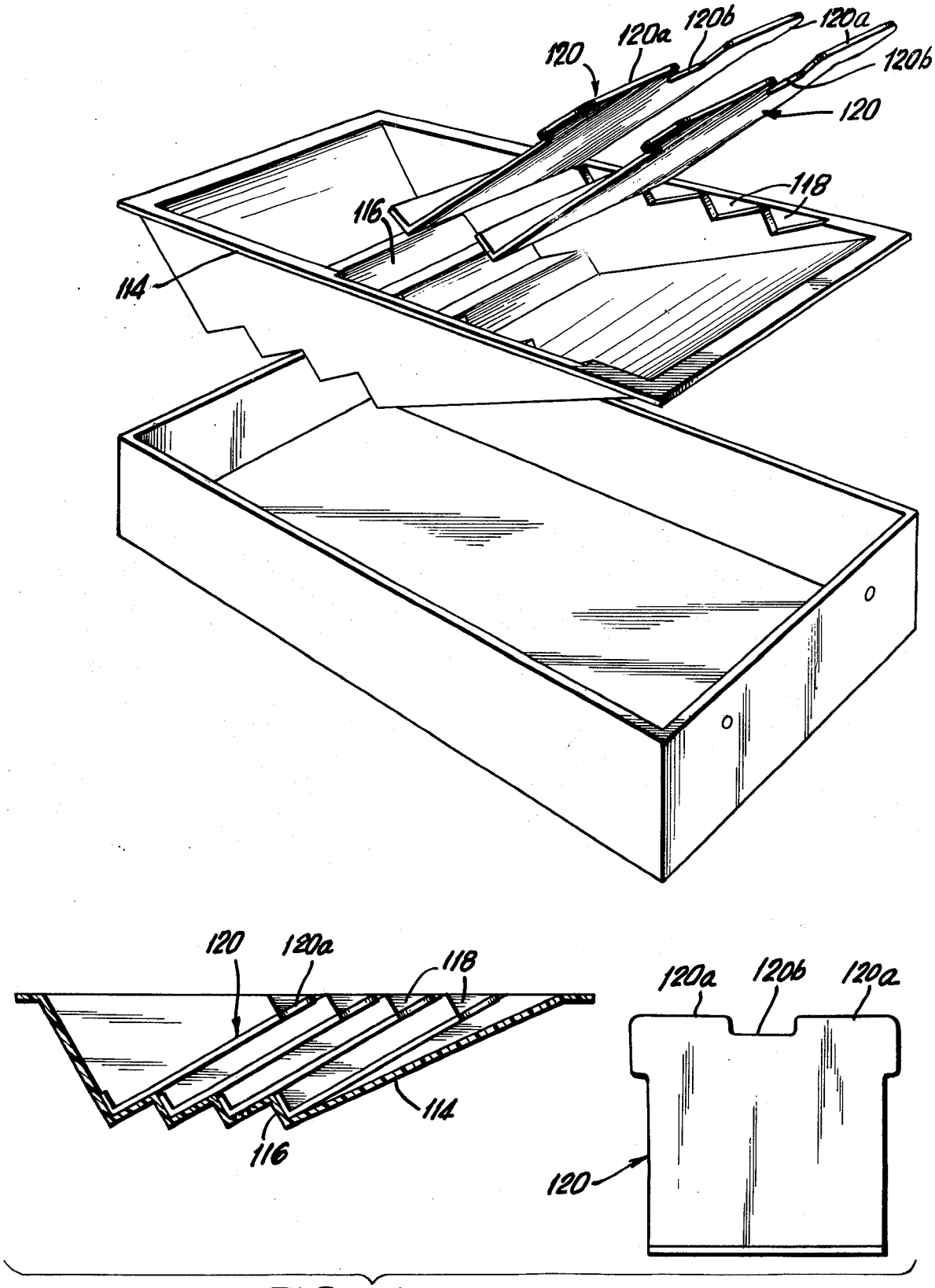
FIGS. 14*a* and 14*b* are views of stationary inserts which may be placed in one of the file drawers.

FIG. 14*a* illustrates one of the uniform file drawers, containing a stationary insert 114 therein. The insert may be of molded plastic, and includes a stepped bottom 116 and ridged side pieces 118. Dividers 120 are included containing tabs 120*a* on the sides thereof that engage the ridged portions 118. The dividers 120 include cut-away portions 120*b*, which permit stationary or other items to be easily grasped that are positioned between adjacent ones of the dividers 120.

Figure 14B:
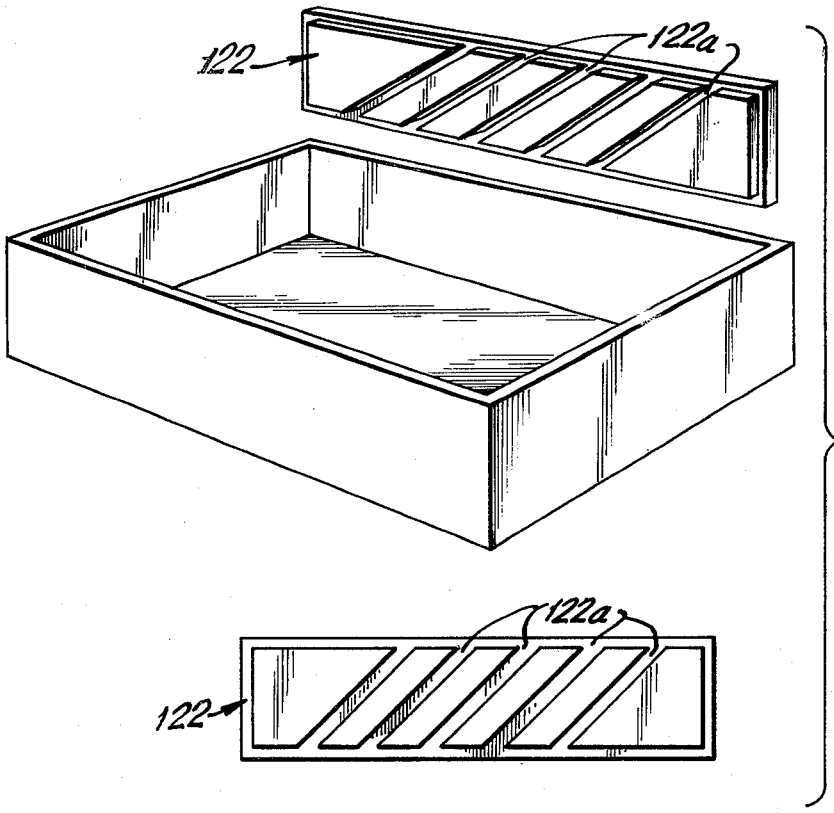
Figure 15:
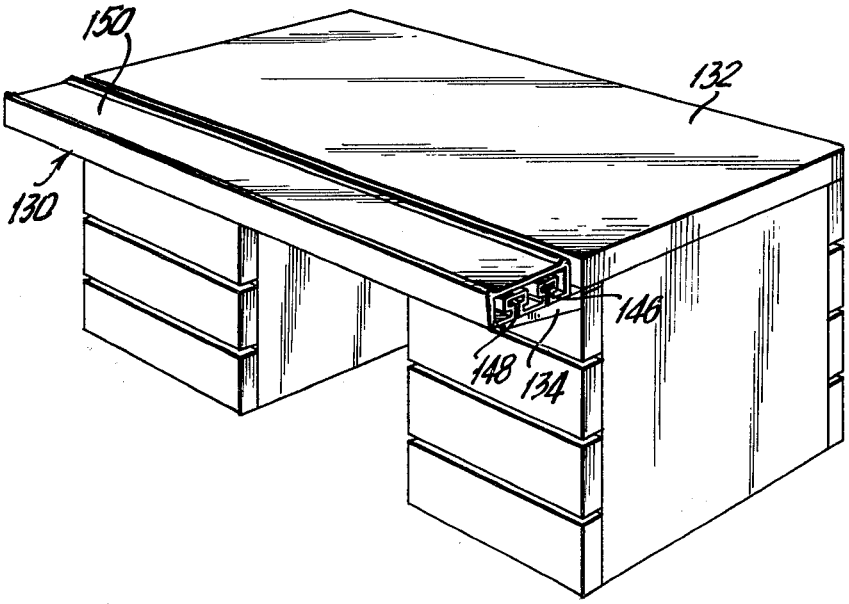
FIG. 15 is a perspective view taken rearwardly of two desk modules joined together by a top slab and including an accessory-supporting track.

FIG. 14*b* shows another form of statioary insert. In this instance, the insert is in the form of two side pieces, one of which is shown in detail (the side piece insert 122 shown in FIG. 14*b*). The insert 122 typically is of molded plastic, and includes channels 122*a* molded in the side thereof. An identical insert is included on the opposing side of the file drawer, and the two inserts are maintained against the sides of the file drawer by the dividers (not shown) that are positioned at opposite ends thereof within the channels 122*a*. Thus the drawer dividers hold the inserts in place within the file drawer.

Figure 16:
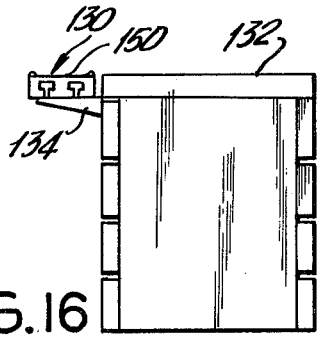
FIG. 16 is a side view of the assembly of FIG. 15.
Figure 17:
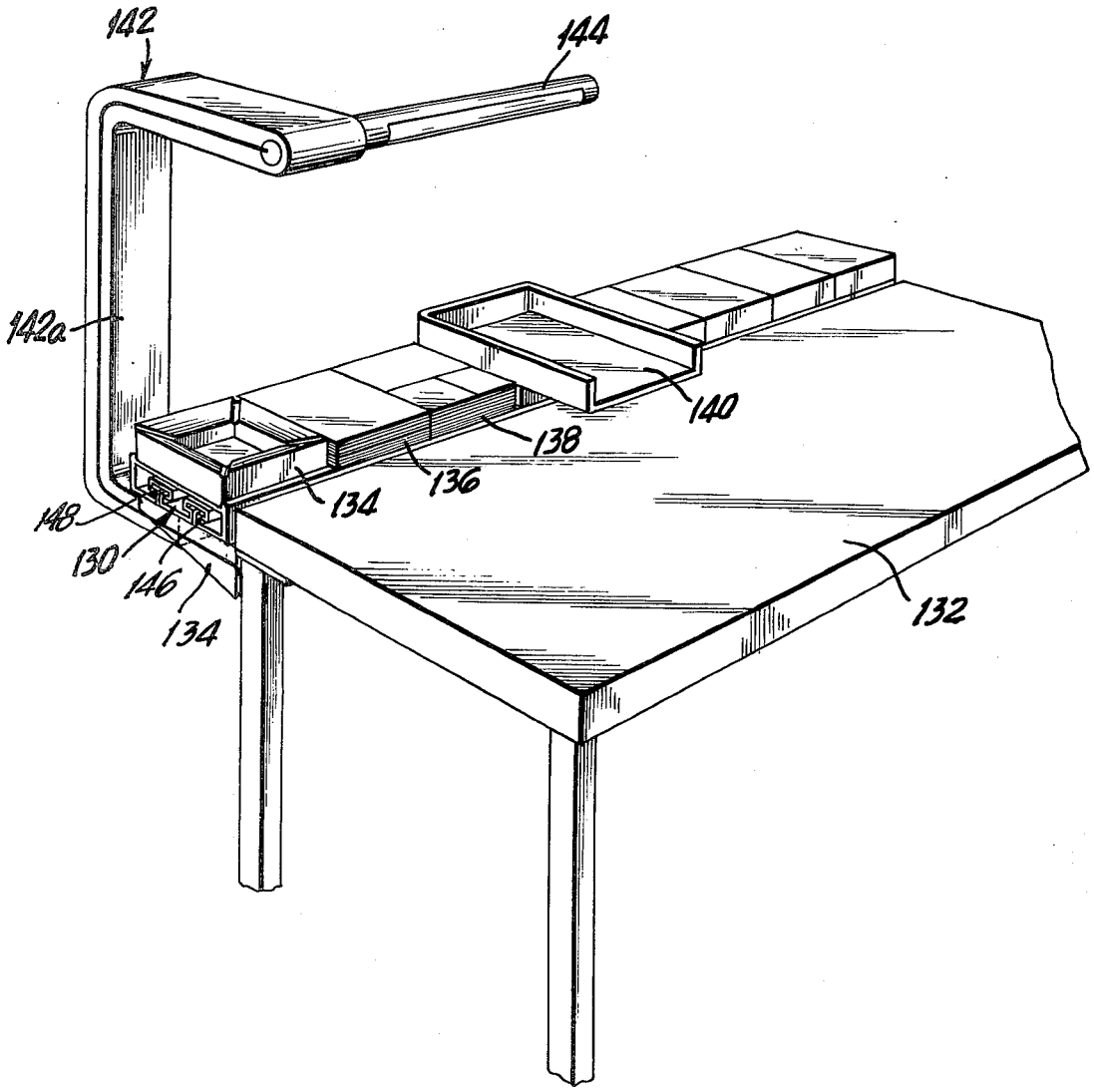
FIG. 17 is a perspective view of the assembly of FIG. 15, taken from the front thereof, showing the accessory track including various accessories therein.

FIGS. 15 to 19 show the details of an accessory track useful with the basic module. The track is designated 130 in FIG. 15 and is positioned at the rear of desk top 132. The accessory track assembly is supported by brackets 134, one of which is shown in FIG. 16 and which will be described in more detail below. FIG. 17 shows the accessory track assembly 130 with various accessories mounted thereon, such as ash tray 134, pads 136, calendar 138, paper tray 140, etc. A light assembly 142 is also mounted to the accessory track, including a fluorescent or other light fixture 144 mounted thereon.

Figure 18:
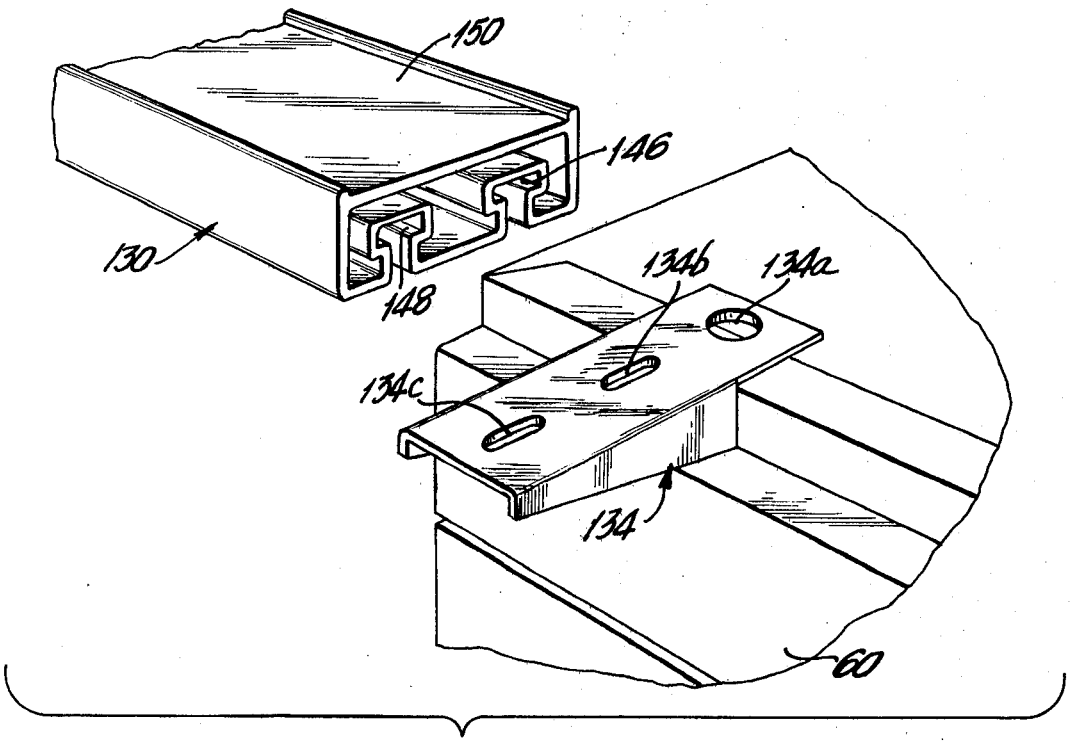
FIG. 18 is an exploded perspective view showing the details of the accessory track and a support bracket mounted on the basic desk module or pedestal.

As shown in FIG. 18, the track assembly 130 is preferably an extruded track having two channels 146 and 148 accessible from the underside thereof (these are basically interior channels) and an upwardly exposed exterior accessory-holding channel 150. Bracket 134 mentioned previously is shown in more detail in FIG. 18, and is mounted to the basic pedestal or desk module 60. The bracket 134 includes a hole 134*a* in registry with one of the spacer connectors 68 (refer to FIG. 4) included on the pedestal-desk module. The bracket 134 is thus sandwiched between that module and the desk-top slab thereover (the desk top slab 132 shown in FIGS. 15 and 16).

Figure 19:
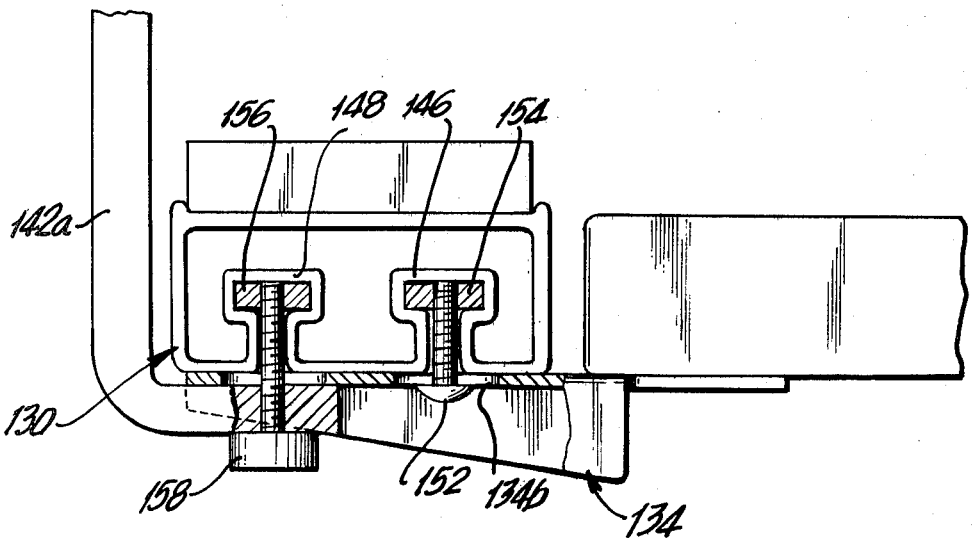
FIG. 19 is a side view of the assembly of FIG. 18, with the various components in position.

The bracket 134 includes additional holes 134*b* and 134*c* therein. As shown in FIG. 19, a bolt 152 or other mounting elements extends through the hole 134*b* and is threaded into nut 154 contained within accessory track channel 146. In this fashion, that accessory track is moved until it is appropriately positioned on the brackets 134, and the bolts 152 and nuts 154 are tightened to hold the track securely in place.

The other accessory track channel 148 may have positioned therein a roller or nut 156, which engages a bolt or other similar holding member 158. The holding member 158 is used to hold a light extension 142*a* forming a part of the light assembly 142 shown in FIG. 17. That light assembly may be moved along the track 130 until it is positioned where desired with respect to the desk top 132; the bolt 158 may or may not be tightened, as desired.

It should be noted that the internal channels 146 and 148 may be useful for other purposes, such as containing electrical conductors. In other words, they may constitute powered tracks.

There has thus been described a versatile desk/pedestal module which is capable of many uses. Representative and presently preferred embodiments have been described above. Not only is the basic module susceptible of forming desks and credenzas, but it also may be useful to form other items of furniture, such as filing cabinets (by stacking one module on top of another). The accessories that accompany the modules provide added versatility to the entire system, and by the use of standardized components manufacturing cost is reduced as well as assembly costs. Assembly procedures are greatly simplified through the use of identically shaped components.

The presently preferred embodiments of this invention described above are obviously susceptible to modification. Accordingly, the invention should be taken to be defined by the following claims.

I claim:

1. A file drawer compressor or follower comprising a sheet of deformable materials having side pieces and a bridging piece joining said side pieces, said side pieces being biased outwardly and each including a recess in the outside surface thereof having a retaining wall about the periphery thereof for holding a compressible material, so that when said sheet is positioned within a file drawer the compressible material within the recesses of the side pieces bears against the sides of said file drawer.

2. A file drawer compressor or follower according to claim 1, in which said sheet is in a general U-shape, so that said compressor or follower is movable generally in only one direction within said file drawer.

* * * * *